US009833787B2

(12) United States Patent
McDevitt

(10) Patent No.: US 9,833,787 B2
(45) Date of Patent: Dec. 5, 2017

(54) FOLDING HOPPER

(71) Applicant: SANDVIK INTELECTUAL PROPERTY AB, Sandviken (SE)

(72) Inventor: Terry McDevitt, Ballybofey (IE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/313,710

(22) PCT Filed: Apr. 28, 2015

(86) PCT No.: PCT/EP2015/059185

§ 371 (c)(1),
(2) Date: Nov. 23, 2016

(87) PCT Pub. No.: WO2015/180915

PCT Pub. Date: Dec. 3, 2015

(65) Prior Publication Data

US 2017/0197218 A1 Jul. 13, 2017

(30) Foreign Application Priority Data

May 26, 2014 (EP) ..... 14169869

(51) Int. Cl.

| | |
|---|---|
| ***B02C 23/02*** | (2006.01) |
| ***B02C 21/02*** | (2006.01) |
| ***B07B 1/00*** | (2006.01) |

(52) U.S. Cl.

CPC ..... *B02C 23/02* (2013.01); *B02C 21/026* (2013.01); *B07B 1/005* (2013.01)

(58) Field of Classification Search

CPC ..... B02C 23/02; B02C 21/026; B02C 21/02; B07B 1/005

USPC ..... 241/101.76, 285.2, 285.3

See application file for complete search history.

(56) References Cited

U.S. PATENT DOCUMENTS

| | | | | |
|---|---|---|---|---|
| 7,004,411 | B2 * | 2/2006 | Nuora | B02C 23/02 241/101.71 |
| 8,925,712 | B2 * | 1/2015 | Dunn | B60P 1/286 16/259 |
| 9,636,686 | B2 * | 5/2017 | Salminen | B02C 21/02 |
| 2003/0226919 | A1 | 12/2003 | Brock et al. | |
| 2004/0035963 | A1 * | 2/2004 | Nuora | B02C 23/02 241/101.76 |
| 2006/0016104 | A1 | 1/2006 | Viitasalo et al. | |
| 2008/0041984 | A1 | 2/2008 | Sauser et al. | |
| 2009/0263194 | A1 * | 10/2009 | Viitasalo | B02C 23/02 404/110 |
| 2012/0175287 | A1 * | 7/2012 | Sauser | B02C 21/02 209/247 |
| 2013/0306437 | A1 * | 11/2013 | Dunn | B60P 1/286 198/632 |

(Continued)

FOREIGN PATENT DOCUMENTS

| | | | |
|---|---|---|---|
| EP | 2664492 | A2 | 11/2013 |
| GB | 2496522 | A | 5/2013 |

*Primary Examiner* — Faye Francis

(74) *Attorney, Agent, or Firm* — Corinne R. Gorski

(57) ABSTRACT

A folding hopper for a bulk material processing machine includes walls that are configured to pivot upwardly and downwardly and to interlock when raised to their uppermost use positions. Interlocking of the wall is achieved exclusively via interlocking hook shaped flanges fixed rigidly to end edges of the hopper walls.

15 Claims, 10 Drawing Sheets

(56) References Cited

U.S. PATENT DOCUMENTS

2014/0124337 A1 5/2014 Murphy

* cited by examiner

FOLDING HOPPER

RELATED APPLICATION DATA

This application is a §371 National Stage Application of PCT International Application No. PCT/EP2015/059185 filed Apr. 28, 2015 claiming priority of EP Application No. 14169869.6, filed May 26, 2014.

FIELD OF INVENTION

The present invention relates to a folding hopper for bulk material processing apparatus and in particular, although not exclusively, to a folding hopper in which side and end walls are capable of being moved between a lowered and a raised position and to interlock via mechanical interlocking flanges.

BACKGROUND ART

Bulk material processing plants or machines can be static or transportable between operational sites. In some instances, the processing machines are transportable to be assembled or configured for use in situ or may be self-propelled to be easily manoeuvred on site and to facilitate loading and unloading at a platform of a transport vehicle.

Example processing plants include screeners, crushers and combined crushing and screening apparatus. These machines typically include a loading hopper which receives a supply of bulk material that is then fed to a screen box or a crusher for subsequent discharge via one or a number of intermediate or discharge conveyors. The supply from the hopper to the primary or secondary processing units (screen or crusher) typically relies on gravity discharge such that the screen or crusher is generally positioned lower than the input hopper that typically determines the maximum height of the processing plant and is the uppermost component. Accordingly, it is known to configure the hopper with walls that are capable of falling or collapsing downwardly to appreciably reduce the overall machine height and allow convenient transport along public highways without risk of impact with overhead obstructions such as bridges and the like. Example foldable hopper arrangements are described in US 2004/0035963; US 2006/0016104; US 2008/0041984; EP 2664492; GB 2496522 and US 2014/0124337.

However, conventional adjustably mounted hoppers are disadvantageous for a number of reasons. In particular, service personnel are often required to physically climb the plant to manually manipulate locking components at the hopper walls. As will be appreciated, in use, the walls must be secured reliably to withstand the significant loading forces that are imparted to the walls as the hopper is supplied with bulk material. Additionally, it is not uncommon for power operated actuators to become worn over time or to fail and this represents a significant safety risk to personnel where the hopper wall locking mechanism relies or is dependent upon the integrity of electronic or fluid based actuators. Accordingly, what is required is a hopper arrangement that addresses these problems.

SUMMARY OF THE INVENTION

It is an objective of the present invention to provide a folding hopper arrangement that provides an automated or semi-automated movement of the hopper walls between a lowered transport position and a raised operative position. It is a further specific objective to provide a hopper assembly having hopper walls that mechanically interlock to provide a secure interconnected unitary structure without the risk of the walls falling unintentionally downward due to wear or failure of electronic or fluid based components or in response to significant loading forces imparted to the hopper walls.

It is a yet further objective to provide an actuating mechanism for a folding hopper that is does not increase the overall width of the bulk material processing apparatus and that may be accommodated conveniently within an inner region of apparatus against or between other components of the processing apparatus.

The objectives are achieved, in part, via a folding hopper arrangement in which the side or end walls of the hopper are configured to be moved between a lowered and a raised position and mechanically interlocked (in the raised position) via remote control without the need for personnel to manually engage locking components.

Advantageously, the present arrangement via the type of mechanical interlocking connections and the power operated actuating mechanisms (configured to move the walls between the lowered and raised positions) is capable of engaging and disengaging lockable flanges at the end (or the start) of the wall movement procedure such that the mechanical lock is actuated via the same mechanical actuators that control and provide the movement of the hopper walls.

Additionally, the locking connections are arranged such that the strength of the locking connection is proportional to the weight of the hopper walls. That is, the present interengaging connections are provided by locking flanges that are attached rigidly to the end and sidewalls and comprise hooked shaped portions configured to overlap one another. Accordingly, the end and sidewalls are held and locked into engagement and prevented from pivoting downwardly under gravity (without the need for support from the power operated movement mechanisms) by the hooked portions that are maintained in the engaged state by the weight of the hopper walls.

The locking and unlocking of the hopper walls is achieved via the power operated actuating mechanism of the side or end wall being configured to displace the wall in a first pivotal movement and a second substantially linear translational movement in the upward and downward direction. In particular, to provide locking engagement, one of the hopper walls may be first pivoted from the lowered position to the raised position where it may then be lowered vertically by the power operated mechanism to allow the side and end wall mounted hooks to interengage. The reverse linear and pivoting movement of the hopper wall may then be conveniently actuated to provide the unlocking of the walls to enable their subsequent downward folding.

According to a first aspect of the present invention there is provided a folding hopper for bulk material processing apparatus comprising: at least one sidewall pivotally mounted to a support frame via at least one first pivot mount; a first power operated mechanism having a first power operated actuator to provide pivoting of the sidewall between a lowered first position and a second raised position; at least one end wall pivotally mounted to the support frame via at least one second pivot mount and extending perpendicular or transverse to the sidewall; a second power operated mechanism having a second power operated actuator to provide pivoting of the end wall between a lowered first position and a second raised position; characterised by: first and second mechanical interlock connections provided respectively at the side and end wall such that when interlocked the side and end walls are prevented from being pivoted from the raised second position to the lowered first position; wherein the first or second power operated mechanism comprises a third power operated actuator configured to provide a translational movement of the side or end wall in an upward and downward direction such that a locking and unlocking of the first and second interlock connections comprises the pivoting and the translational movement of the side or end wall.

Preferably, the first and second interlock connections comprise flanges having hooked portions that are configured to overlap one another when interlocked. Preferably, the flanges are positioned at or towards respective end edges of the side and end walls to engage one another as the end edges are mated in touching or near touching contact when the walls are in the raised first position. The hooked portions are advantageous to ensure a secure and reliable interconnection of the hopper walls and to provide sufficient physical overlap of the rigid flanges. The flanges are shaped and dimensioned to have sufficient integrity and strength to support the weight of the hopper walls exclusively and importantly without a reliance on additional electronic or fluid based actuators. The end regions of the hooked portions on each wall are effective to prevent the adjacent wall from unintentionally falling downward by representing an abutment to hold and retain the adjacent wall in the raised position.

Optionally, the first power operated mechanism comprises a first arm pivotally mounted to a second arm such that the first and second arms are configured to fold relative to one another and the support frame when the sidewall is moved to the lowered first position and to align to form a straightened support brace when the sidewall is in the raised second position. Such an arrangement is beneficial to provide further support to the sidewalls and in turn the end wall so as to stabilise the walls against impact loading forces.

Optionally, the second arm is pivotally mounted to the frame and the first arm is attached to the sidewall such that the first and second arms are configured to fold inwardly towards a position underneath the hopper when the sidewall is moved to the lowered first position. Advantageously, the folding mechanism does not present a safety hazard to operating personnel as it folds inwardly and also enables the apparatus to be operated in confined regions or in close proximity to other processing devices or structures that would otherwise not be possible with an outward folding mechanism.

Preferably, the first power actuator is attached at a region of the first arm and a region of the second arm. Such an arrangement is advantageous to provide a direct coupling between the actuator and the movable arms to enable the actuator to be isolated when the arms are straightened. Preferably, the first power actuator is mounted at the first arm and the second arm such that when the arms are aligned to form the straightened support brace the first powered actuator is isolated from compressive forces transmitted through the support brace from the sidewall.

Optionally, the second power actuator is mounted to extend between the frame and the end wall and the third power actuator is mounted to extend between the frame and the second pivot mount to provide a translational movement of the second pivot mount in the upward and downward direction. The third power actuator is preferably mounted directly in contact with the end wall so as to maintain to a minimum the load transmitted through the actuator in raising and lowering the end wall during operation.

Optionally, the second pivot mount comprises: a mount bracket provided at the support frame, the bracket having a first elongate slot; and a first pivot pin about which the end wall can pivot, the first pivot pin slidably mounted within the elongate slot. A pivot pin and slot arrangement is advantageous to provide a reliable and lightweight mechanism for displacing the hopper wall and in particular to minimise the number of working components and the overall complexity of the mechanism.

Preferably, the third power actuator is mounted to act on the first pivot pin to cause the first pivot pin to slide in the upward and downward direction within the first slot; and the second power actuator is mounted between the end wall and the bracket to cause the end wall to rotate about the first pivot pin. Movably mounting the third power actuator is advantageous to minimise stress at the actuator by maintaining the desired loading angles and limiting the range of extension of the actuator to achieve longevity of the operating components.

Preferably, the third power actuator is mounted at the bracket via a second pivot pin slidably mounted within a second elongate slot provided in the bracket, the third power actuator configured to move in the upward and downward direction with the translational movement of the end wall. The pin and slot arrangement is advantageous to provide a reliable mechanism for displacing the actuator without the need for additional components that would otherwise increase the complexity and weight of the movement mechanism.

Preferably, the second power operated mechanism comprises: a pair of brackets, a pair of first pivot pins and a pair of first and second elongate slots; and a pair of second power operated actuators and a pair of third power operated actuators provided respectively at each bracket. Such an arrangement is beneficial to provide a robust and stable movement mechanism whilst maintaining to a minimum the weight of the components associated with displacing the hopper wall.

Preferably, the apparatus further comprises at least one cover shield pivotally mounted to hang from a region of the end wall to cover the second and third power operated actuators when the end wall in the raised second position. The shield is beneficial to provide a safety guard for operational personnel and to at least partially cover the internal components of the actuating mechanism from dust and debris during use. Preferably, the apparatus comprises a plurality of guards or shields to protect and cover all actuating mechanisms associated with the hopper walls.

Preferably, the apparatus comprises two sidewalls wherein each wall comprises a plurality of the flanges at a respective end edge, each flange of the sidewalls arranged such that each hook portion extends upwardly; and wherein the end wall comprises a plurality of flanges at each end edge wherein each flange of the end wall is arranged such that each hook portion extends downwardly; wherein when the flanges are interlocked the respective upward and downward extending hook portions overlap to interlock the sidewalls with the end wall.

According to a second aspect of the present invention there is provided mobile bulk material processing apparatus comprising: a mainframe; a processing unit supported at the mainframe; tracks or wheels to allow the apparatus to move over the ground; and a folding hopper as claimed herein to contain material to be fed to the processing unit.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
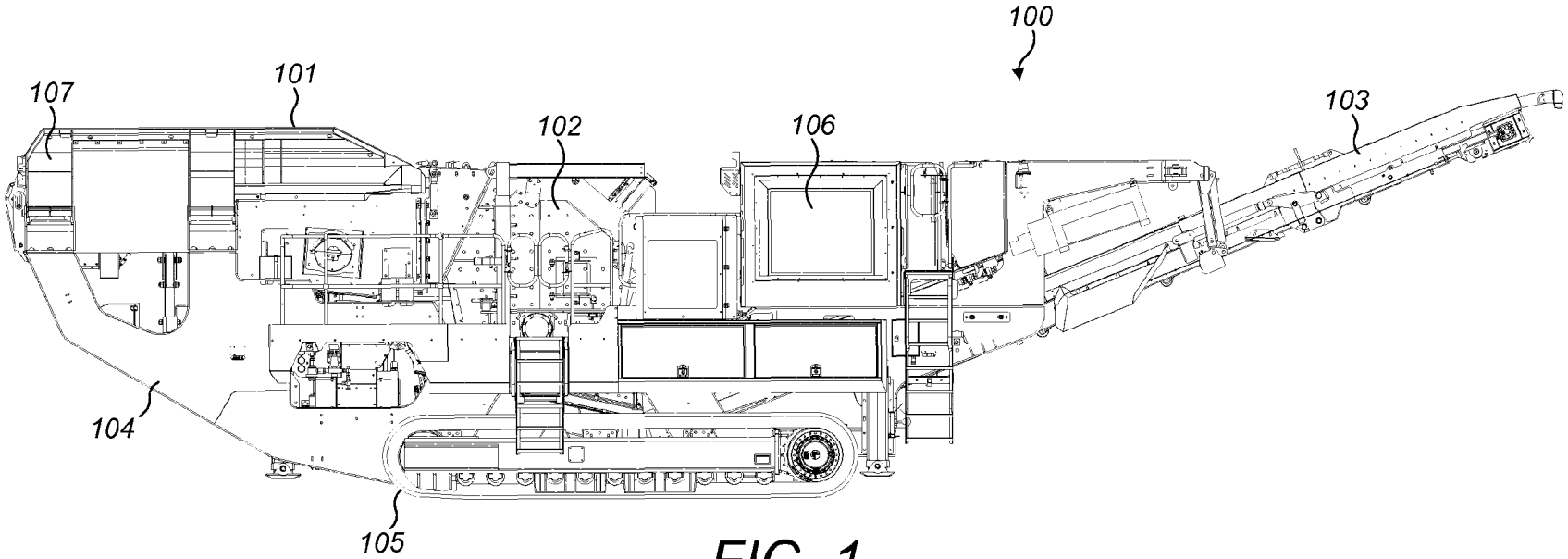
FIG. 1 is an external side elevation view of a mobile crushing apparatus having a mainframe, a crusher, a feed hopper and tracks to enable the apparatus to be self-propelled over the ground according to a specific implementation of the present invention.

Referring to FIG. 1, a bulk material processing machine 100 comprises a mainframe 104 that supports an undercarriage to mount a pair of endless tracks 105 to enable machine 100 to be self-propelled over the ground. Machine 100 further comprises a primary motor 106, an input feed hopper indicated generally by reference 101, a material crusher 102 and a discharge conveyor 103. Hopper 101 comprises folding hopper walls 107 movable between a raised uppermost position (illustrated in FIG. 1) and a pivoted or collapsed lower position (illustrated in FIGS. 9 and 10).

Figure 2:
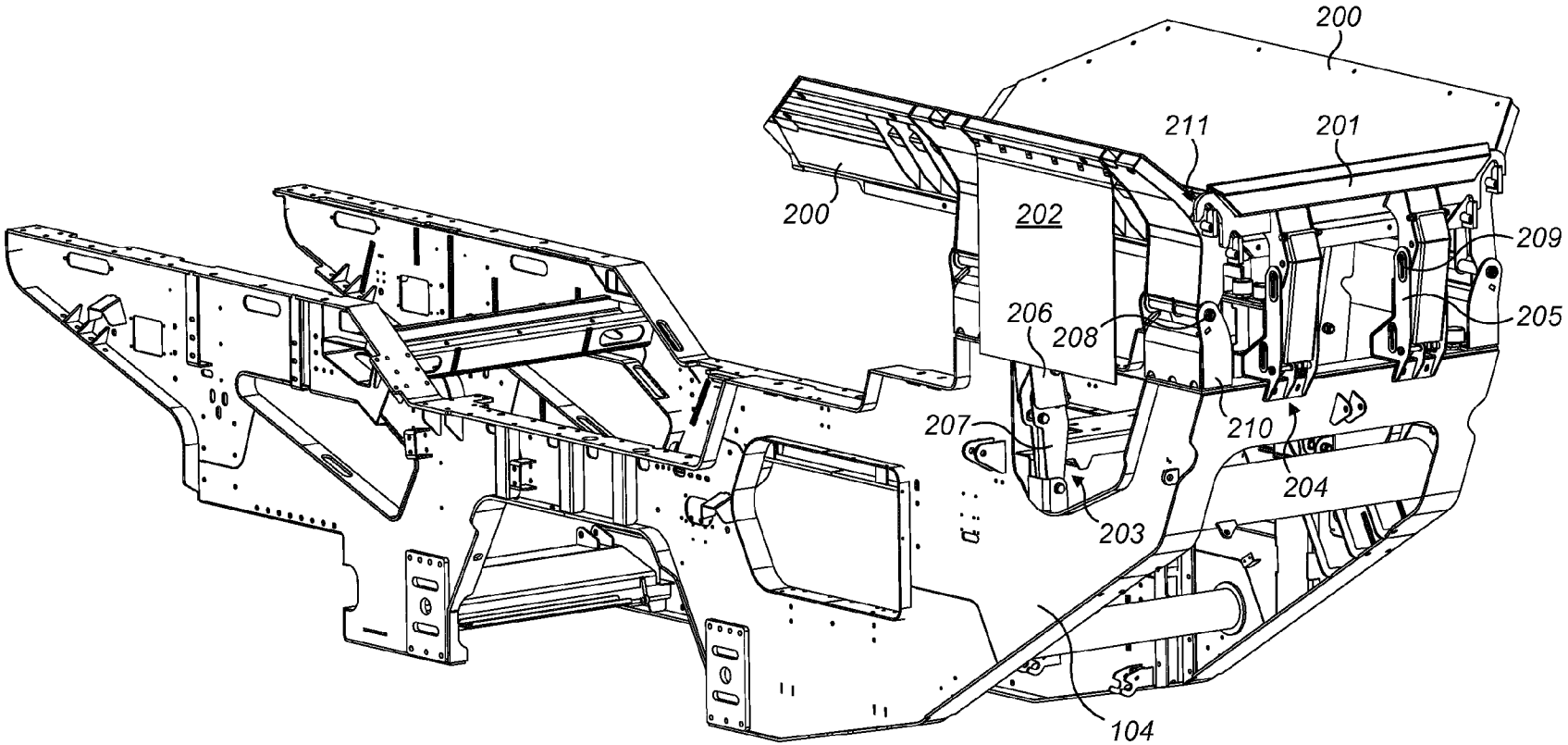
FIG. 2 is a rear perspective view of the mainframe and input hopper of the apparatus of FIG. 1 according to the specific implementation.
Figure 3:
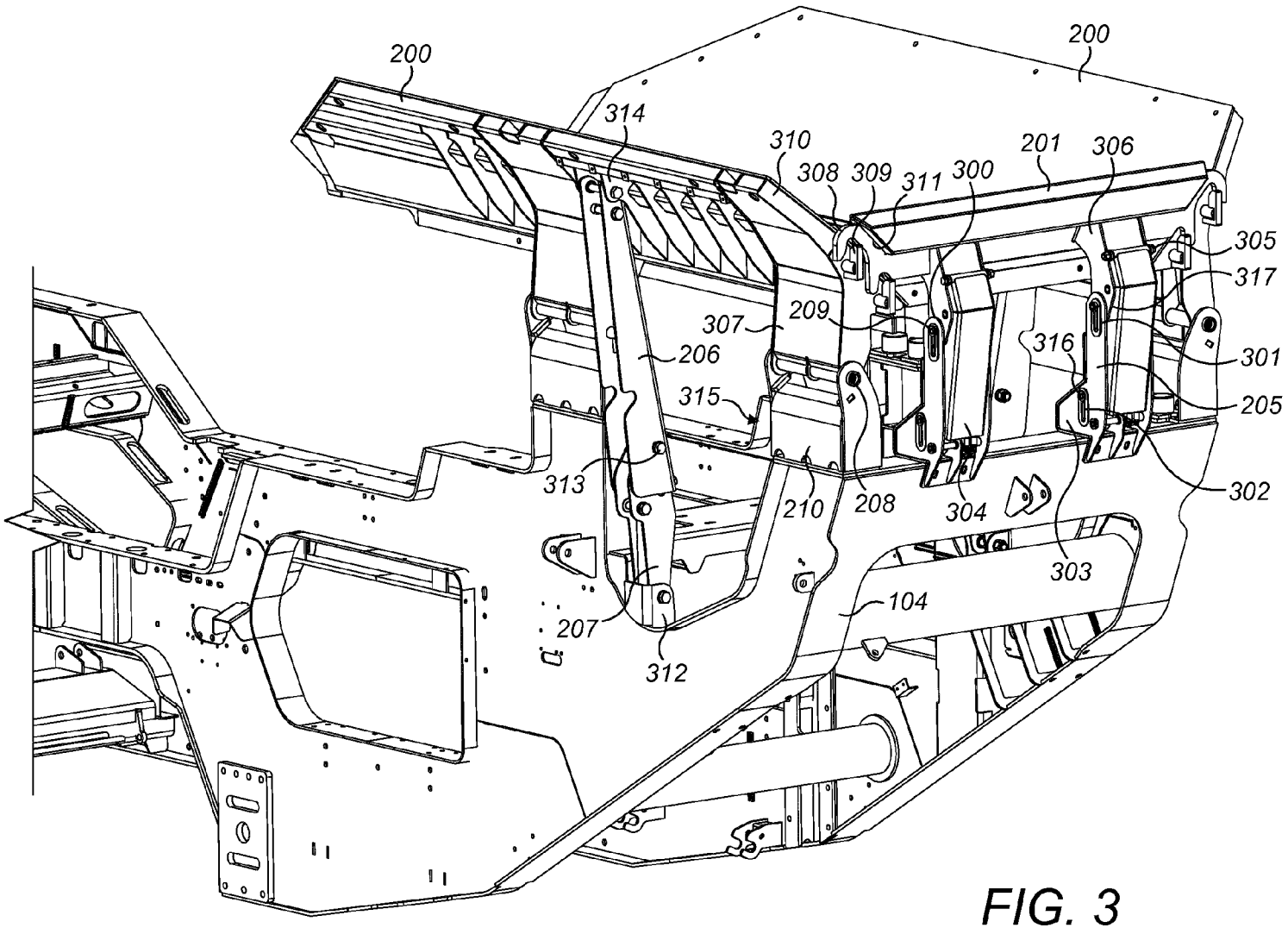
FIG. 3 is a further rear perspective view of the hopper and mainframe of FIG. 2 with selected components removed for illustrative purposes.

Referring to FIGS. 2 and 3, hopper 101 comprises a pair of sidewalls 200 aligned generally with a longitudinal axis of mainframe 104 and an end wall 201 provided at a rear end of machine 100 and extending generally perpendicular to sidewalls 200. With walls 200, 201 orientated in the uppermost raised position of FIG. 2, end wall 201 extends between a rear edge 310 of each sidewall 200 so as to enclose the inner region of hopper 101 to contain the fed bulk material. In particular, end wall 201 comprises a pair of end edges 311 configured to mate in touching or close touching contact with the sidewall end edges 310.

Figure 4:
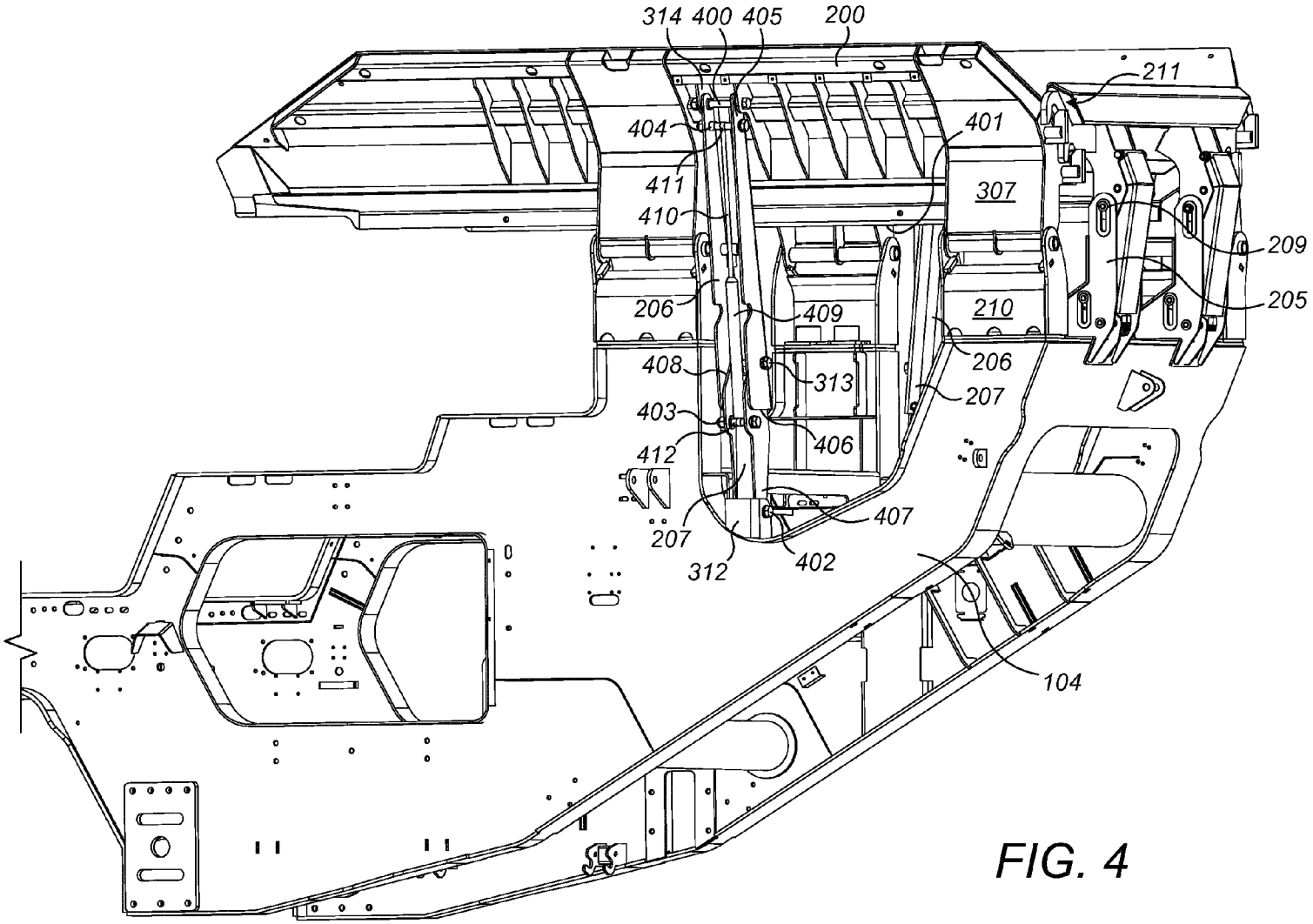
FIG. 4 is a side perspective view of the hopper and mainframe of FIG. 3 with selected components removed for illustrative purposes.
Figure 9:
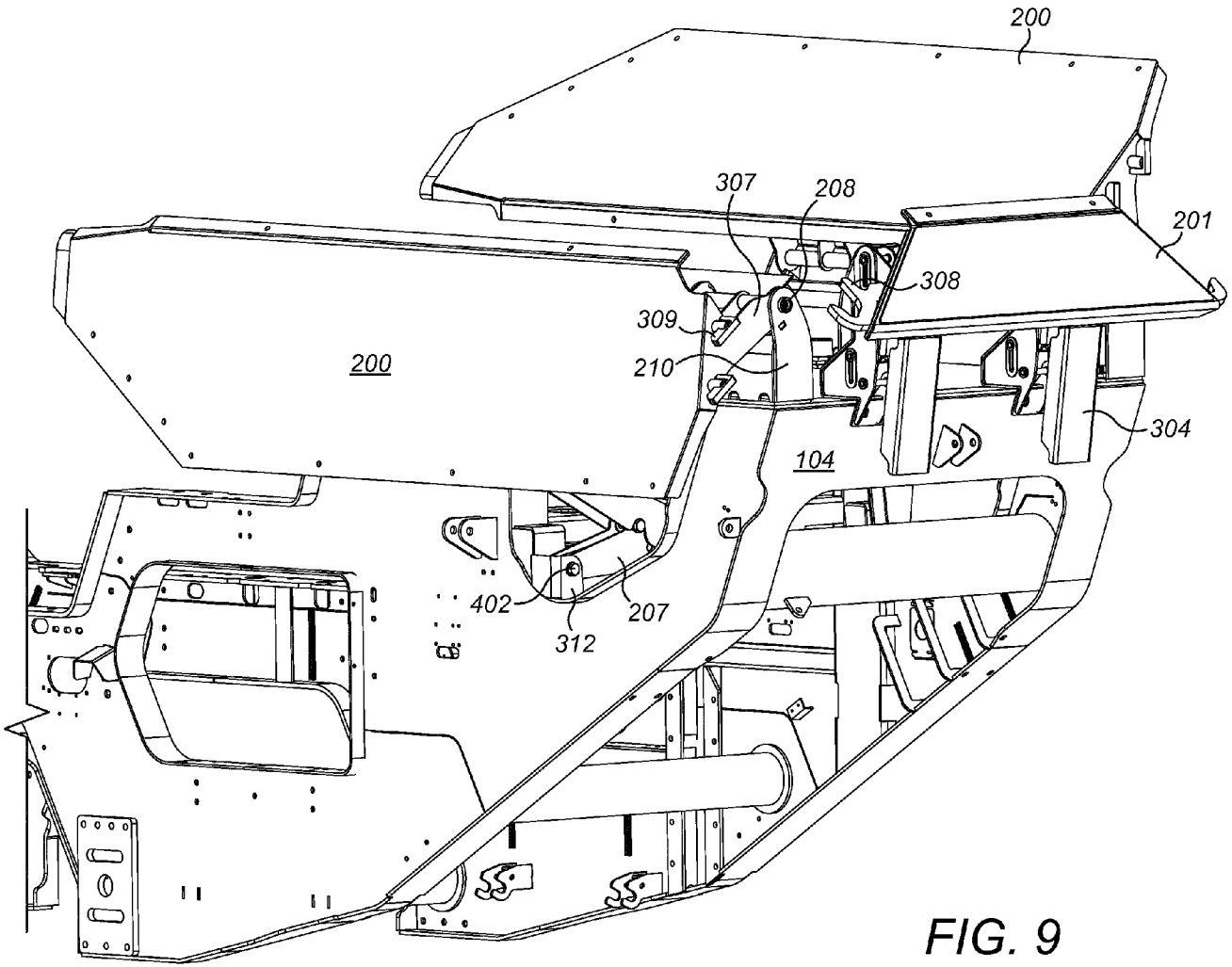
FIG. 9 is a rear perspective view of the hopper and mainframe of FIG. 8 with a sidewall and end wall pivoted downwardly to their lowest positions with selected components removed for illustrative purposes.

Machine 100 comprises a pair of first power operated mechanisms indicated generally by reference 203 configured to actuate raising and lowering of each sidewall 200 between the positions of FIG. 1 and FIG. 9. Each mechanism 203 comprises a first elongate arm 206 pivotally mounted to a relatively short second arm 207. Referring to FIG. 4, first arm 206 comprises first uppermost end 405 pivotally attached to a mount region 314 provided at an outermost part of sidewall 200 via a pivot pin 400. The second lowermost end 406 of first arm 206 is pivotally mounted at an uppermost end 408 of second arm 207 via a pivot pin 313. Second arm 207 is pivotally mounted to frame 104 via a base mount 312. In particular, a lower end 407 of arm 207 is received within base mount 312 and pivotally mounted via pivot pin 402.

A power operated linear actuator (in the form of a hydraulic cylinder) 409 is mounted at respective ends to first and second arms 206, 207. In particular, a lowermost end 412 of cylinder 409 is pivotally mounted to pivot pin 403 at second arm 207. Cylinder 409 comprises a retractable rod 410 that is mounted at its uppermost end 411 to first arm 206 via pivot pin 404. Accordingly, via actuation of cylinder 409, first and second arms 206, 207 are configured to fold or collapse inwardly via pivot pin 313 such that in their folded or hinged configuration, arms 206, 207 extend generally inwardly to region 315 positioned substantially below a lower region 401 of hopper 101. In particular, the inward folded arms 206, 207 are illustrated further in FIG. 10 such that the first arm lower end 406 and the second arm upper end 408 are positioned immediately below hopper region 401 when the arms are collapsed. Advantageously, the first and second arms 206, 207 do not fold or hinge outwardly that would otherwise increase the overall width of machine 100. Moreover, each of the sidewall actuating mechanisms 203 are configured so as to not interfere with one another when hinged to the position of FIG. 10.

Pivoting of each sidewall 200 is achieved via a pair of pivot mounts provided at a rearward end and towards a forward end of each sidewall 200. Each pivot mount comprises a base mount 210 provided at mainframe 104 and a sidewall mount 307 extending generally downward from an outside region of each sidewall 200. Mount 307 is configured to pivot relative to mount 210 via an intermediate pivot pin 208. Each power operated mechanism 203 and in particular arms 206 and 207 are shielded by a substantially planar plate 202 pivotally mounted to the outside of each sidewall 200. Plate 202 hangs downwardly to conceal arms 206, 207 and cylinder 409 to both protect the mechanism from dust and debris and to increase the operational safety of the apparatus 100 with regard to operating personnel.

Figure 8:
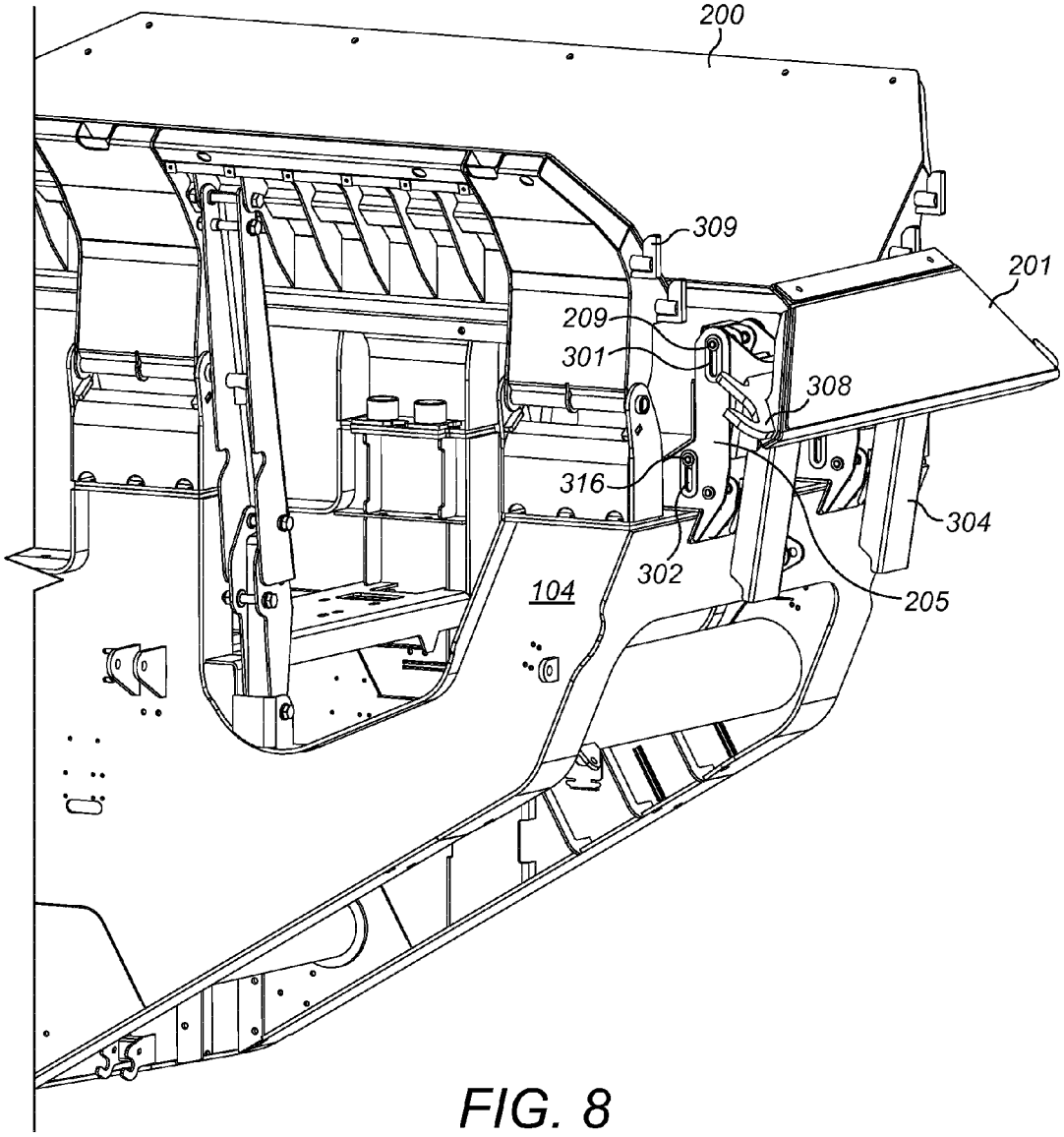
FIG. 8 is a further rear perspective view of the hopper and mainframe of FIG. 7 with the end wall pivoted to a lowest position with selected components removed for illustrative purposes.

Machine 100 further comprises a pair of second power operated mechanisms indicated generally by reference 204. Each second mechanism 204 is mounted to extend between a rear part of mainframe 104 and end wall 201 to be capable of actuating raising and lowering of end wall 201 between the raised position of FIG. 1 and the lowered position of FIG. 8. Each mechanism 204 comprises an upstanding mount bracket 205 rigidly mounted at frame 104 and formed by a pair of spaced apart plate like bodies. Bracket 205 comprises an upper region 300 positioned closest to the upper region of end wall 201 and a lower region 303 mounted at frame 104. A first substantially vertically extending elongate slot 301 is provided at bracket upper region 300 and a second substantially vertically extending elongate slot 302 is provided at bracket lower region 303. Both slots 301, 302 are aligned substantially parallel and are spaced apart in a vertical direction by the main length of bracket 205. The end wall 201 comprises a pair of generally downwardly projecting wall mounts 306 each having a lowermost end 317 that is at least partially received within each bracket upper region 300. A pivot pin 209 is slidably mounted within slot 301 and extends through wall mount end 317 to pivotally couple end wall 201 to each bracket 205 and, in turn, frame 104. Accordingly, end wall 201 is capable of pivoting in the upward and downward direction via pivot pin 209. An elongate guard 304 hangs from each wall mount 306 via a pivot pin 305 and is shaped and dimensioned to conceal the internal components of each power operated mechanism 204. That is, the internal components of each mechanism 204 are encased within each bracket 205 and guard 304.

Figure 5:
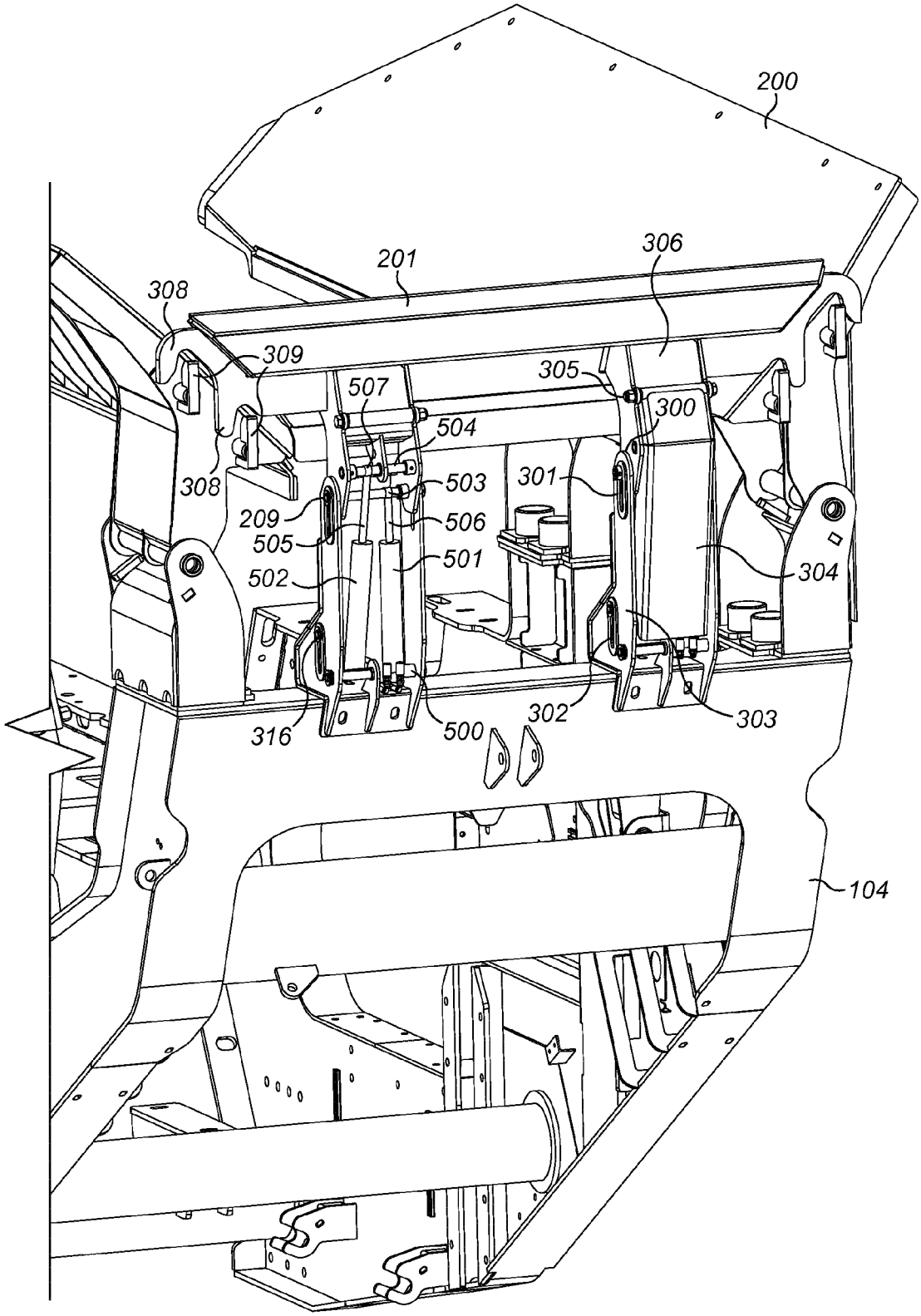
FIG. 5 is a rear perspective view of the hopper and mainframe of FIG. 4 with selected components removed for illustrative purposes.
Figure 6:
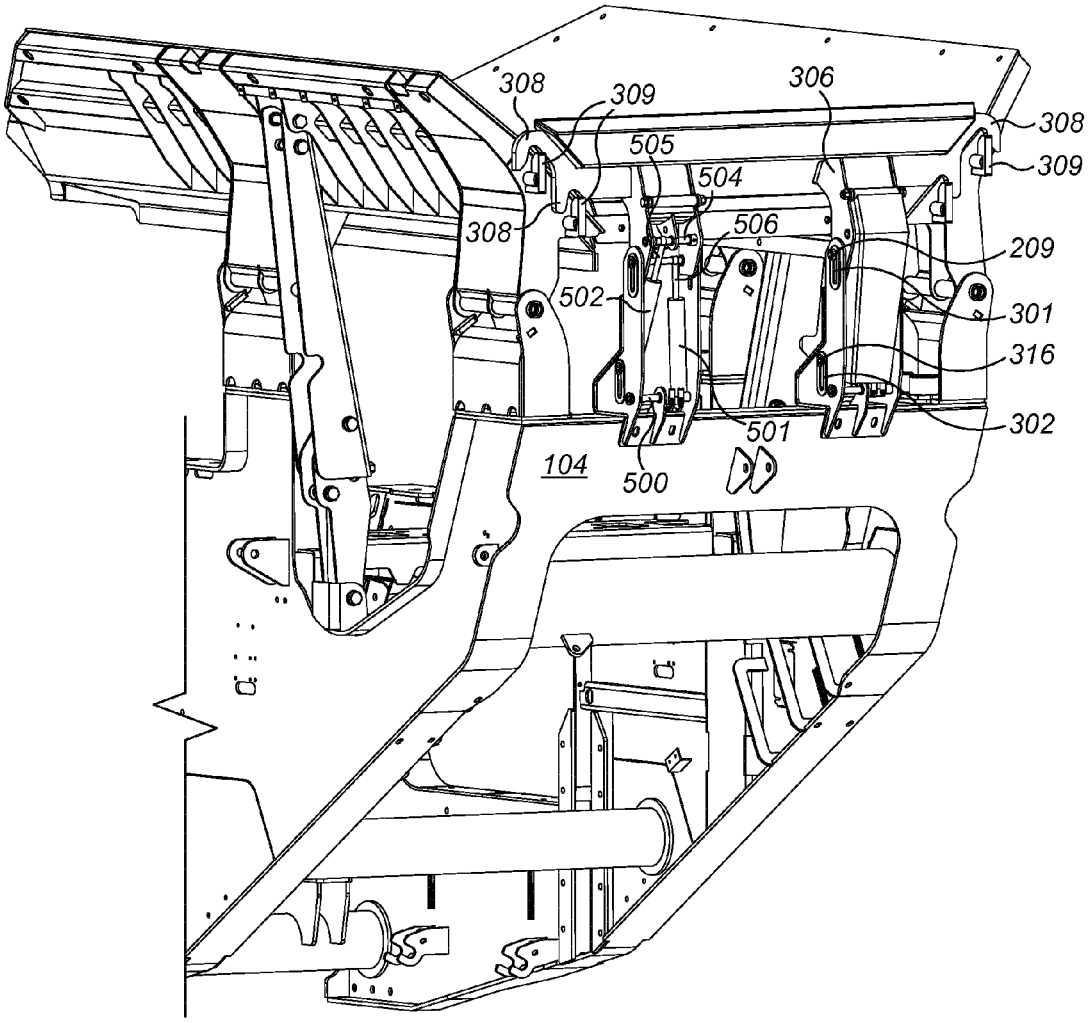
FIG. 6 is further rear perspective view of the hopper and mainframe of FIG. 5 with an end wall in a raised position to disengage hopper wall interlock connections having selected components removed for illustrative purposes.
Figure 7:
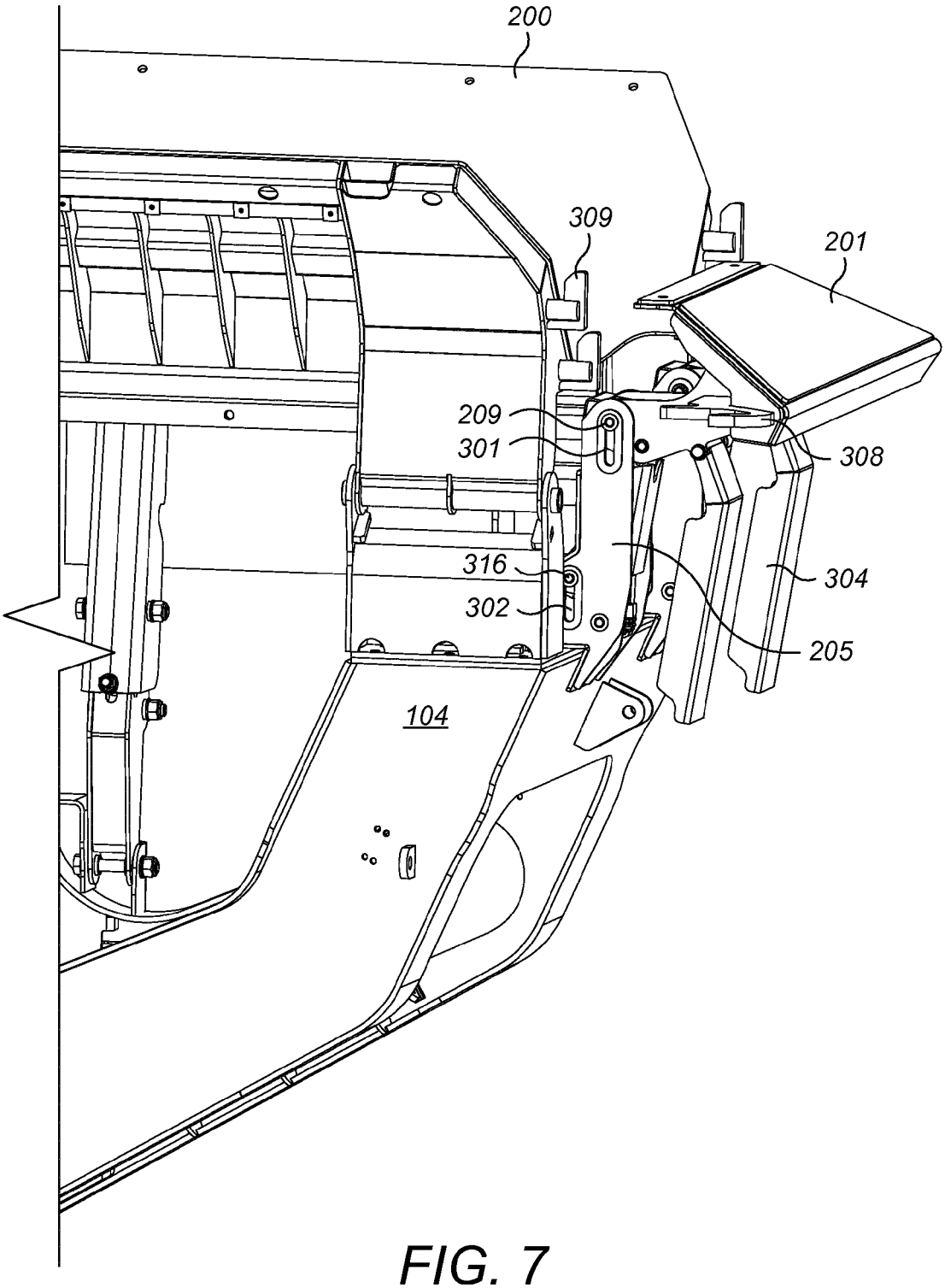
FIG. 7 is a rear perspective view of the hopper and mainframe of FIG. 6 with the end wall pivoted to a lowered intermediate position.

Referring to FIGS. 3, 5 and 6, each mechanism 204 comprises a pair of power operated linear actuators (in the form hydraulic cylinders) 501, 502 positioned side by side within the internal space defined by each bracket 205. Cylinder 502 is aligned to be inclined relative to the horizontal such that an uppermost end 507 of an elongate rod 505 (retractably mounted at cylinder 502) is positioned rearwardly of a lowermost end of cylinder 502. In particular, cylinder 502 (via its lowermost end) is moveably mounted at bracket 205 via a pivot pin 316 that is slidably mounted within lower elongate slot 302. Uppermost rod end 507 is in turn mounted at a pivot pin 504 that is attached to wall mount 306. Neighbouring cylinder 501 also comprises a retractably mounted elongate rod 506 having an uppermost end 503. Upper end 503 is mounted at pivot pin 209 whilst a lowermost end of cylinder 501 is mounted at a lower pivot pin 500 attached to bracket lower region 303.

Accordingly, via each mechanism 204, end wall 201 is configured to move in a substantially linear upward and downward translational direction and to pivot or fold in the upward and downward direction. In particular, the linear vertical raising and lowering of end wall 201 is provided by actuating cylinder 501. As rod 506 is extended from cylinder 501, pivot pins 209 and 316 are configured to slide in a vertical direction within the respective slots 301, 302. Pivoting of end wall 201 is provided by actuation of cylinder 502 such that the change in length of retractable rod 505 causes wall mount 306 to pivot about pin 209. That is, cylinder 502 is also displaced vertically via the actuation of cylinder 501 to maintain the actuation alignment angle of cylinder 502 relative to wall mounts 306.

So as to secure hopper walls 107 in the raised position of FIG. 1, each wall 107 comprises a plurality of interlocking flanges indicated generally by reference 211. In particular, to provide a reliable and conveniently engagable and releasable lock, each flange 211 is formed exclusively as a mechanical component being rigidly mounted to each respective wall 200, 201. As such, flanges 211 are fixed rigidly to each respective wall 200, 201 and the walls 200, 201 may be interlocked together exclusively by the frictional contact and mechanical interlock provided by flanges 211.

In particular, each sidewall 200 comprises a pair of flanges 211 having hooked portions 309 projecting rearward from the rear end edge 310 at a location at or just above wall mount 307. Each hook portion 309 is orientated such that the hook projects generally upward. Similarly, end wall 201 comprises a pair flanges 211 provided at each lengthwise end edge 311. Each end wall flange 211 comprises a corresponding hooked portion 308 projecting in the widthwise direction from end edge 311. Each hooked portion 308 is orientated to be downward facing so as to mate in overlapping contact against the respective hooked portions 309 of wall flanges 211 when the walls 107 are in the uppermost raised position of FIG. 1.

The hooked portions 308, 309 within each pair are positioned above and below one another so as to be spaced apart in the vertical direction. With walls 200, 201 in the upright position, end wall 201 may be considered to be hooked onto and supported by each sidewall 200 via overlapping engagement of the respective hooked portions 308, 309. Additionally, sidewalls 200 in the raised position of FIG. 1 are further supported by arms 206, 207 that are capable of aligning to extend parallel to one another to form a straightened support brace or strut as illustrated in FIG. 3. That is, arms 206, 207 are configured to pivot to a straightened 'locked-out' position. Such a configuration is advantageous to isolate each cylinder 409 from compressive forces imparted by the weight of sidewall 200 and impact forces as hopper 101 is loaded with bulk material. Arms 206, 207 also support the interlocking of hooked portions 308, 309 so as to provide a robust and reliable hopper wall interlocking assembly.

Figure 10:
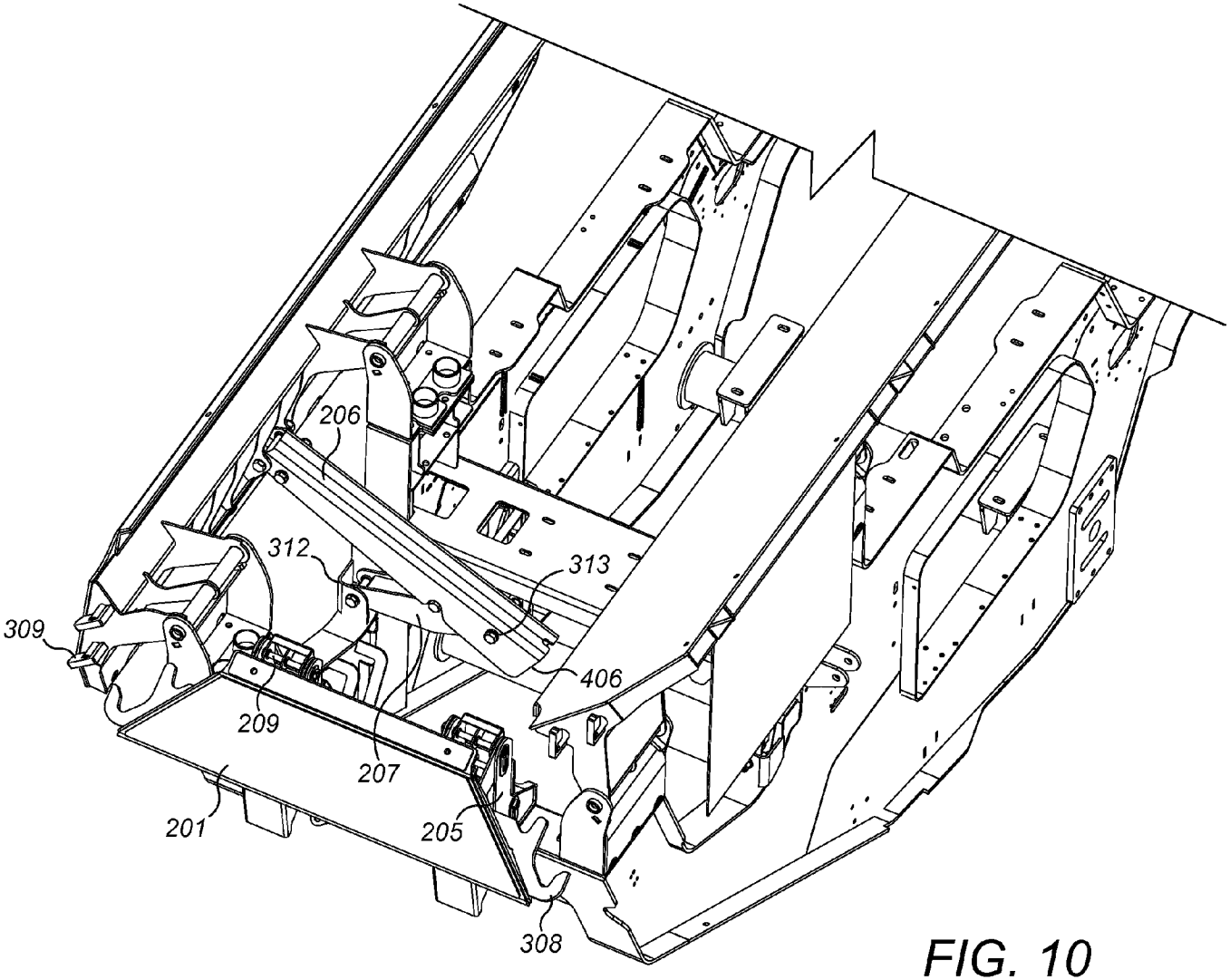
FIG. 10 is an upper perspective view of the hopper and mainframe of FIG. 9 with a sidewall and end wall pivoted to their lowest positions.

Engagement and disengagement of hooked portions 308, 309 is achieved via a combined actuation of cylinders 409, 501 and 502. Referring to FIGS. 3 to 10, with the walls 107 in the upright position of FIG. 1, end wall 201 is initially displaced upwardly in the vertical direction by actuation of cylinder 501. Pivot pins 209, 316 are therefore caused to slide within corresponding slots 301, 302 as illustrated in FIGS. 5 and 6. This initial linear translational movement as shown in FIG. 6 disengages hooked portions 308 from hooked portions 309. End wall 201 is then capable of pivoting downwardly about pivot pins 209 via actuation of cylinder 502 to achieve the partially pivoted orientation of FIG. 7. Wall 201 continues to pivot to the fully lowered position of FIG. 8 with pins 209, 316 still positioned at the uppermost end of respective slots 301, 302. Accordingly, cylinder 502 is maintained in the upward displaced position via cylinder 501. Cylinder 409 is then actuated to fold inwardly first and second arms 206, 207 into region 315 as illustrated in FIGS. 9 and 10. Accordingly, each sidewall 200 is folded downwardly about pivot pins 208 to the fully declined position of FIGS. 9 and 10. The configuration of arms 206, 207 to fold inwardly is advantageous to maintain to a minimum the overall width of machine 100 and to provide a convenient region 401 below the hopper main body to accommodate other components such as a fines conveyor (not shown).

Raising and interlocking walls 107 is then achieved by the reverse order of steps involving both the pivotal movement of the side walls 200 then end wall 201 followed by the linear vertical lowering of end wall 201 to complete the interlocking of hooked portions 308, 309.

The invention claimed is:

1. A folding hopper for a bulk material processing apparatus, the folding hopper comprising:

at least one sidewall pivotally mounted to a support frame via at least one first pivot mount;

a first power operated mechanism having a first power operated actuator to provide pivoting of at least one sidewall between a lowered first position and a second raised position;

at least one end wall pivotally mounted to the support frame via at least one second pivot mount and extending perpendicular or transverse to the at least one sidewall;

a second power operated mechanism having a second power operated actuator arranged to pivot the at least one end wall between a lowered first position and a second raised position; and first and second mechanical interlock connections provided respectively at the at least one sidewall and the at least one end wall such that when interlocked the at least one sidewall and the at least one end wall are prevented from being pivoted from the raised second position to the lowered first position, wherein the first or second power operated mechanism includes a third power operated actuator configured to provide a translational movement of the at least one sidewall or the at least one end wall in an upward and downward direction such that a locking and unlocking of the first and second interlock connections includes the pivoting and the translational movement of the at least one sidewall or the at least one end wall.

2. The apparatus as claimed in claim 1, wherein the first and second interlock connections include flanges having hooked portions that are configured to overlap one another when interlocked.

3. The apparatus as claimed in claim 2, wherein the flanges are positioned at or towards respective end edges of the at least one sidewall and the at least one end wall to engage one another as the end edges are mated in touching or near touching contact when the at least one sidewall and the at least one end wall are in the raised first position.

4. The apparatus as claimed in claim 1, wherein the first power operated mechanism includes a first arm pivotally mounted to a second arm such that the first and second arms are configured to fold relative to one another and the support frame when the at least one sidewall is moved to the lowered first position and to align to form a straightened support brace when the at least one sidewall is in the raised second position.

5. The apparatus as claimed in claim 4, wherein the second arm is pivotally mounted to the frame and the first arm is attached to the at least one sidewall such that the first and second arms are configured to fold inwardly towards a position underneath the hopper when the at least one sidewall is moved to the lowered first position.

6. The apparatus as claimed in claim 4, wherein the first power actuator is attached at a region of the first arm and a region of the second arm.

7. The apparatus as claimed in claim 6, wherein the first power actuator is mounted at the first arm and the second arm such that when the arms are aligned to form the straightened support brace the first powered actuator is isolated from compressive forces transmitted through the support brace from the at least one sidewall.

8. The apparatus as claimed in claim 1, wherein the second power actuator is mounted to extend between the frame and the at least one end wall and the third power actuator is mounted to extend between the frame and the second pivot mount to provide a translational movement of the second pivot mount in the upward and downward direction.

9. The apparatus as claimed in claim 8, wherein the second pivot mount includes a mount bracket provided at the support frame, the mount bracket having a first elongate slot and a first pivot pin about which the at least one end wall is arranged to pivot, the first pivot pin being slidably mounted within the elongate slot.

10. The apparatus as claimed in claim 9, wherein the third power actuator is mounted to act on the first pivot pin to cause the first pivot pin to slide in the upward and downward direction within the first slot and the second power actuator is mounted between the at least one end wall and the bracket to rotate the at least one end wall about the first pivot pin.

11. The apparatus as claimed in claim 10, wherein the third power actuator is mounted at the mount bracket via a second pivot pin slidably mounted within a second elongate slot provided in the bracket, the third power actuator being configured to move in the upward and downward direction with the translational movement of the at least one end wall.

12. The apparatus as claimed in claim 11, wherein the second power operated mechanism includes a pair of mount brackets, a pair of first pivot pins, a pair of first and second elongate slots, a pair of second power operated actuators and a pair of third power operated actuators provided respectively at each mount bracket.

13. The apparatus as claimed in claim 10, further comprising at least one cover shield pivotally mounted to hang from a region of the at least one end wall to cover the second and third power operated actuators when the at least one end wall is in the raised second position.

14. The apparatus as claimed in claim 3, comprising two sidewalls, each of the sidewalls including a plurality of the flanges at a respective end edge, each flange of the sidewalls being arranged such that each hook portion extends upwardly, and the at least one end wall including a plurality of flanges at each end edge, each flange of the at least one end wall being arranged such that each hook portion extends downwardly, wherein when the flanges are interlocked the respective upward and downward extending hook portions overlap to interlock the sidewalls with the at least one end wall.

15. A mobile bulk material processing apparatus comprising:

a mainframe;

a processing unit supported at the mainframe;

tracks or wheels arranged to allow the apparatus to move over the ground; and a folding hopper arranged to contain material to be fed to the processing unit, the folding hopper including at least one sidewall pivotally mounted to a support frame via at least one first pivot mount, a first power operated mechanism having a first power operated actuator to provide pivoting of the at least one sidewall between a lowered first position and a second raised position, at least one end wall pivotally mounted to the support frame via at least one second pivot mount and extending perpendicular or transverse to the at least one sidewall, a second power operated mechanism having a second power operated actuator to provide pivoting of the at least one end wall between a lowered first position and a second raised position, and first and second mechanical interlock connections provided respectively at the at least one sidewall and the at least one end wall such that when interlocked the at least one sidewall and the at least one end wall are prevented from being pivoted from the raised second position to the lowered first position, wherein the first or second power operated mechanism includes a third power operated actuator configured to provide a translational movement of the at least one sidewall or the at least one end wall in an upward and downward direction such that a locking and unlocking of the first and second interlock connections includes the pivoting and the translational movement of the at least one sidewall or the at least one end wall.

* * * * *